United States Patent [19]

Rudbach

[11] 4,135,636

[45] Jan. 23, 1979

[54] OUTLET PIPE CLOSURE FOR LIQUID CONTAINERS

[75] Inventor: Michael Rudbach, Dierdorf-Wienau, Germany

[73] Assignee: Udo Schutz KG, Selters, Germany

[21] Appl. No.: 796,186

[22] Filed: May 12, 1977

[30] Foreign Application Priority Data

May 15, 1976 [DE] Fed. Rep. of Germany ... 7615545[U]
Dec. 16, 1976 [DE] Fed. Rep. of Germany ..... 2657009

[51] Int. Cl.[2] ..... B65D 41/20

[52] U.S. Cl. ..... 220/265; 217/111; 222/83; 222/541

[58] Field of Search ..... 220/258, 265, 266; 222/83, 507, 541; 217/111

[56] References Cited

U.S. PATENT DOCUMENTS 3,227,317 1/1966 Bereziat et al. ..... 222/83

3,405,837 10/1968 Carpenter, Jr. ..... 220/258

*Primary Examiner*—George T. Hall

*Attorney, Agent, or Firm*—Young & Thompson

[57] ABSTRACT

A liquid container with an outlet pipe has a closure for the outlet pipe comprising a cap screw and a closure element disposed between the outlet pipe and the cap screw. The closure element has an integral sealing diaphragm across its bore, which diaphragm may be ruptured to initiate flow of the liquid. The sealing diaphragm has a cup-shaped depression at its periphery. The cap screw has a coarse thread on one side that mates with screw threads on the outlet pipe, and a finer thread on the other side for receiving a flow control member. The cap screw has an internal flange between the two sets of screw threads, which contacts an external flange on the closure element. The cap screw carries an external screw engageable with the container to prevent undesired rotation of the cap screw.

3 Claims, 8 Drawing Figures

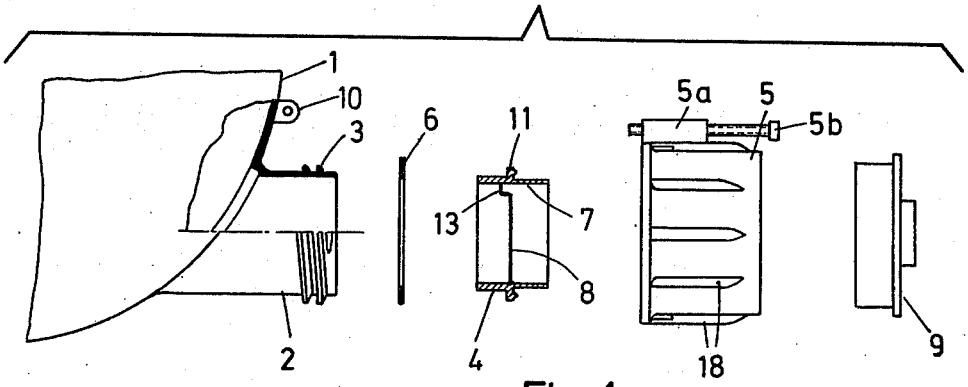
Fig. 1
Fig. 2
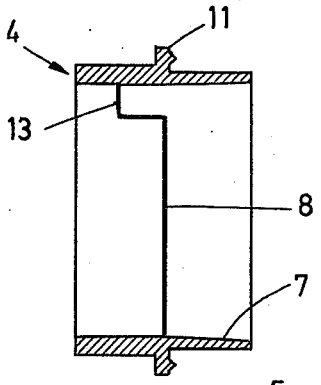
Fig. 3
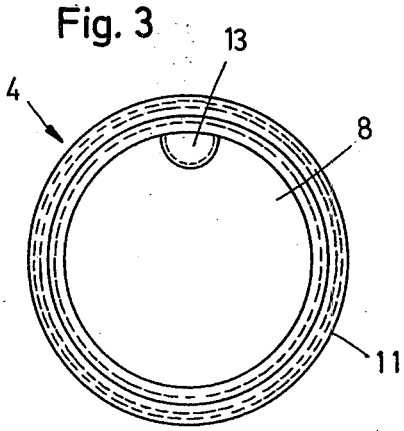
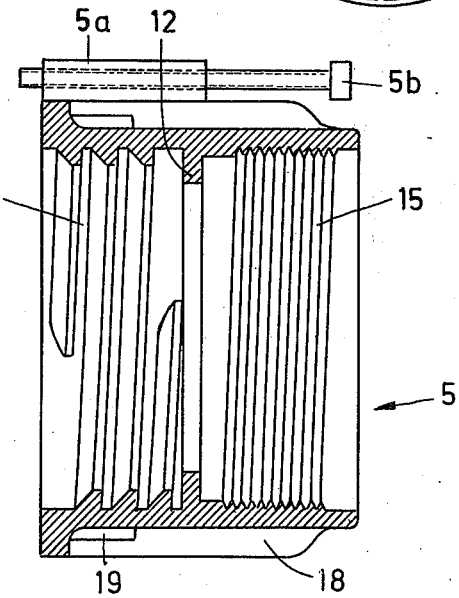
Fig. 4

OUTLET PIPE CLOSURE FOR LIQUID CONTAINERS

The invention relates to an outlet pipe closure for liquid containers, especially one-way containers for liquids, and is based on the object of fashioning an outlet pipe closure so that it can be provided with a discharge cock for emptying the container, this cock being either capable of being threadedly inserted or being driven into the container.

To attain this object, the outlet pipe closure of this invention is characterized by a closure element, inserted between the outlet pipe and a cap screw, this closure element having a sealing diaphragm integrally formed therewith in the passage bore thereof.

In a suitable further development of the invention, the sealing diaphragm has a depression shaped like a cup on the container side at a location in the proximity of the wall of the bore of the closure element. The cap screw has, on the container side, a coarse thread for being placed over the outlet pipe and at the other end has a finer thread for the threaded insertion of a sealing plug and/or a screw-in drain cock, and between the threads of the cap screw an inner flange is provided contacted by the closure element with an outer flange. A sealing ring can be arranged between the closure element and the outlet pipe.

For the use of a tapping or driven-in cock, a sleeve is provided which has a section on the cock side for receiving a tapping member of the cock and a section on the container side with a forward cutting edge for severing the sealing diaphargm.

In contrast thereto, if a threaded-in cock is to be installed, the invention provides a holding ring for a cutting pin to cut the sealing diaphragm apart.

In order to secure the cap screw when the closure element is removed by turning, the cap screw has at least one extension with a threaded bore extending in parallel to its axis to receive a locking screw.

The drawings show an outlet pipe closure of this invention in one embodiment thereof, to wit:

FIG. 1 shows in an exploded view the outlet pipe closure with the accessories required for the shipping and transporting of a container;

FIG. 2 shows the closure element in an axial section;

FIG. 3 shows the rear view of the closure element according to FIG. 2;

FIG. 4 shows the cap screw in an axial section;

FIG. 7 shows a rear view of the holding ring according to FIG. 6; whereas

Figure 5:
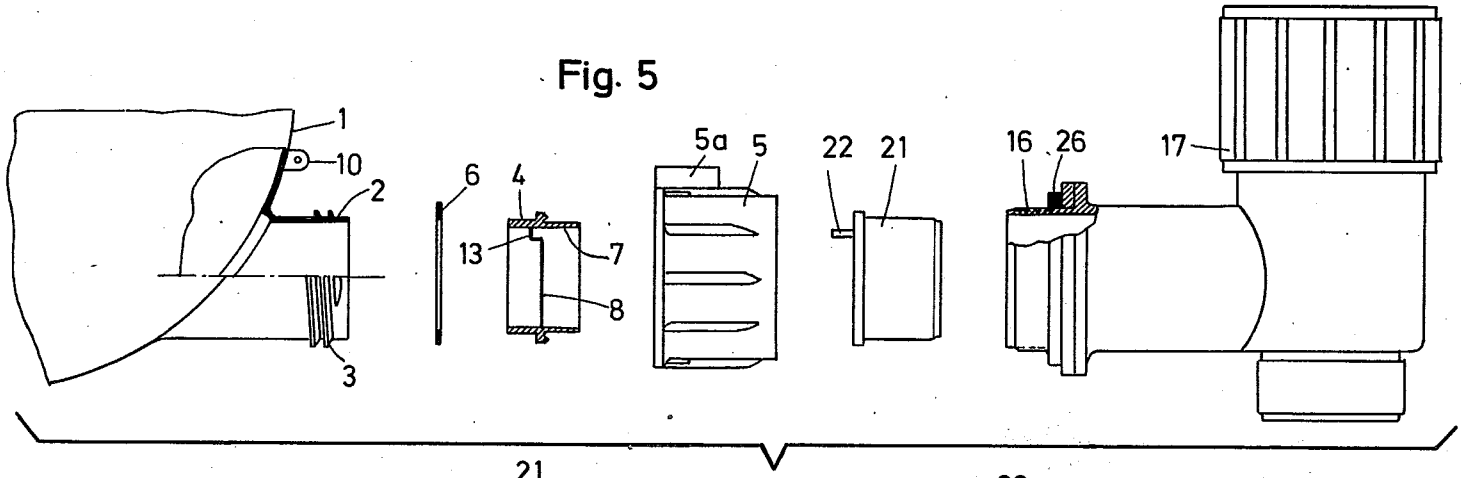
FIG. 5 shows in an exploded view the outlet pipe closure with the accessories necessary for attaching a threaded-in discharge cock.

The outlet pipe closure according to FIG. 1, intended for the shipping of liquid containers 1, has an outlet pipe 2 provided with an external, coarse thread 3 on which a cap screw 5 is attached for fastening a closure element 4 in the outlet pipe 2. A sealing ring 6 is arranged between the closure element 4 and the outlet pipe 2. In the passage bore 7 of the closure element 4, a sealing diaphragm 8 is mounted. Further details of the closure element 4 will be described hereinbelow with reference to FIGS. 2 and 3. Individual features of the cap screw 5 will be explained while referring to FIG. 4. To protect the sealing diaphragm 8 during transportation, a sealing plug 9 is provided which is threadedly inserted in the cap screw 5; for shipping purposes, the screw cap can be lead-sealed to the container 1 at a lead-sealing eye 10.

The closure element 4 (see also FIGS. 2 and 3) exhibits, in addition to the sealing diaphragm 8 integrally formed in the passage bore 7, an outer flange 11 approximately in the center of its longitudinal dimension; this outer flange contacts, on the container side, the sealing ring 6 and, on the outer side, an inner flange 12 of the cap screw 5 (see FIG. 4). The sealing diaphragm 8 has a cup-shaped depression 13 facing the container 1 at a location in the proximity of the wall of the passage bore 7; the purpose of this depression will be explained in greater detail below. The relatively thin sealing diaphragm 8 (e.g. 0.2–0.5 mm.) prevents the drainage of the liquid present in container 1.

As shown in detail in FIG. 4, the cap screw 5 has a coarse internal thread 14 fitting on the coarse thread 3 of the outlet pipe 2. Furthermore, the cap screw 5 contains a finer thread 15 in the end of its inner bore facing away from container 1; this finer thread fits to the thread of the sealing plug 9 and to the insert thread 16 of a threaded-in outlet cock 17 (FIG. 5). The two threads 14, 15 of the cap screw 5 are separated from each other by the inner flange 12. On the outside, the cap screw 5 has longitudinally oriented ribs 18 serving, with recesses 19, for suspending a lead-sealing wire (not shown).

To secure the cap screw 5 when the sealing plug 9 is rotated outwardly, the cap screw 5 has at least one extension 5*a* receiving, with an axially parallel extending threaded bore, a locking screw 5*b*; when the cap screw 5 is firmly threaded in place, this locking screw is threaded against the wall of the container 1 which is inclined in the zone of the outlet pipe 2 and prevents, when the sealing plug 9 is loosened, a concomitant rotation of the cap screw.

Figure 8:
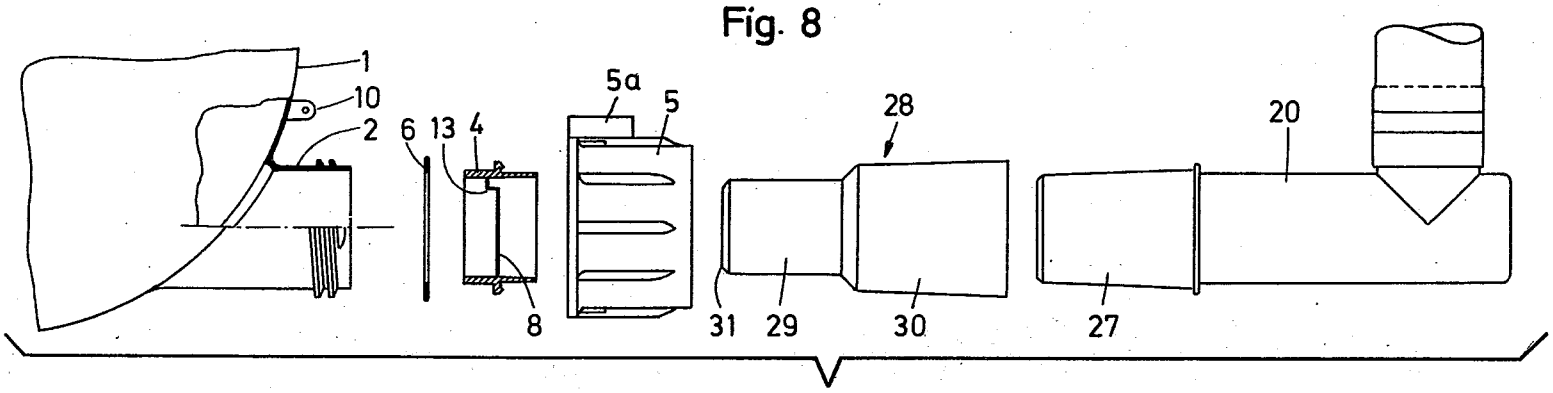
FIG. 8 shows in an exploded view the outlet pipe clsoure with the accessories required for attaching a driven-in or tapping cock.

The container 1, fashioned, for example, as a one-way container having a capacity of 600 or 800 liters, is emptied either by means of the threaded-in discharge cock 17 or by means of a tapped-in cock 20 (FIG. 8). In order to emply the container 1, the sealing plug 9 (FIG. 1) is removed first of all, and during this step the cap screw 5 is not released on account of the screw 5*b*. The threaded-in discharge cock 17 is equipped with a holding ring 21 for a cutting pin 22; the latter cuts open the sealing diaphragm 8 up to the cup-shaped depression 13 approximately at the third revolution when the cock 17 is threadedly inserted. The sealing diaphargm remains suspended from this cup-shaped depression 13 in the passage bore 7 of the closure element 4 and thus cannot enter into the stream of liquid.

Figure 7:
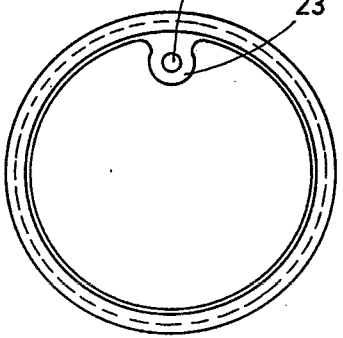
Figure 6:
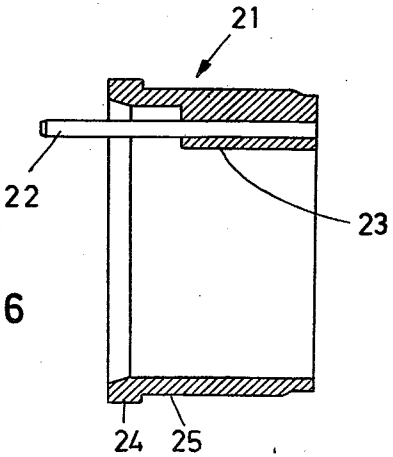
FIG. 6 shows the holding ring for the cutting pin in an axial section.

The holding ring 21 with the cutting pin 22 is illustrated in detail in FIGS. 6 and 7. The cutting pin 22 is firmly seated in a socket member 23 on the inner periphery of the holding ring 21 which has an outer annular collar 24 contacting, after the treaded insertion of the cock 17, the inner flange 12 of the cap screw. With a sleeve-like section 25, the holding ring 21 is seated in the threaded-in discharge cock 17, the latter being sealed with a sealing ring 26 (FIG. 5) on the cap screw 5.

FIG. 8 shows the mounting of the aforementioned driven-in cock 20, having a tapping member 27, at the outlet pipe 2. In order to sever the sealing diaphragm 8 of the closure element 4 during the tapping-in of the cock 20, a sleeve 28 is provided for receiving the tapping member 27 of the cock 20. The sleeve 28 fits, with a forward section 29, into the passage bore 7 of the closure element 4, while a slightly conical rearward sleeve section 30 receives the tapping member 27 of the cock 20. The sealing diaphragm 8 is sheared off by a cutting edge 31 of the forward section 29 of the sleeve 28 except for the cup-shaped depression 13. During this process, the sealing diaphragm 8 jams against the sleeve 28 and thus cannot enter into the liquid to be discharged.

Although the present invention has been described and illustrated in connection with preferred embodiments, it is to be understood that modifications and variations may be resorted to without departing from the scope of the invention, as those skilled in this art will readily understand. Such modifications and variations are considered to be within the purview and scope of the present invention as defined by the appended claims.

What is claimed is:

1. A container for liquid having an outlet pipe, a cap screw which is screw-threadedly received on said outlet pipe, a closure element disposed between said outlet pipe and said cap screw and having a passageway therethrough closed by an integral sealing diaphragm, and a sleeve for receiving a driven-in cock, said sleeve comprising a section on the cock side for receiving a tapping member of the cock and a section on the container side with a forward cutting edge to sever the sealing diaphragm.

2. A container for liquid having an outlet pipe, a cap screw which is screw-threadedly received on said outlet pipe, a closure element disposed between said outlet pipe and said cap screw and having a passageway therethrough closed by an integral sealing diaphragm, said cap screw having, on the container side, a coarse thread for threading onto said outlet pipe, and, on the other side, a finer thread for the retention of a flow control member, and a holding ring for a cutting pin to cut the sealing diaphragm apart, said holding ring being disposed between said cap screw and said flow control member.

3. A container for liquid having an outlet pipe, a cap screw which is screw-threadedly received on said outlet pipe, a closure element disposed between said outlet pipe and said cap screw and having a passageway therethrough closed by an integral sealing diaphragm, the cap screw having at least one extension with a threaded bore extending parallel to its axis, and a locking screw disposed in said bore for engagement with a portion of the container to prevent rotation of the cap screw.

* * * * *